US007111669B2

(12) United States Patent
Höglinger et al.

(10) Patent No.: US 7,111,669 B2
(45) Date of Patent: Sep. 26, 2006

(54) HEAT EXCHANGER

(75) Inventors: Markus Höglinger, Stuttgart (DE); Stefan Rogg, Stuttgart (DE)

(73) Assignee: BEHR GmbH Co. KG, Stuttgart (DE)

( * ) Notice: Subject to any disclaimer, the term of this patent is extended or adjusted under 35 U.S.C. 154(b) by 75 days.

(21) Appl. No.: 10/496,013

(22) PCT Filed: Nov. 16, 2002

(86) PCT No.: PCT/EP02/12877

§ 371 (c)(1),
(2), (4) Date: Jun. 28, 2004

(87) PCT Pub. No.: WO03/046457

PCT Pub. Date: Jun. 5, 2003

(65) Prior Publication Data

US 2005/0006067 A1 Jan. 13, 2005

(30) Foreign Application Priority Data

Nov. 29, 2001 (DE) ..... 101 58 436

(51) Int. Cl.
*F28D 1/053* (2006.01)

(52) U.S. Cl. ..... 165/140; 165/153; 165/174

(58) Field of Classification Search ..... 165/140, 165/149, 151–153, 172–176
See application file for complete search history.

(56) References Cited

U.S. PATENT DOCUMENTS

| | | | | |
|---|---|---|---|---|
| 4,516,630 | A | 5/1985 | Yamaguchi | |
| 6,321,562 | B1 * | 11/2001 | Narahara et al. | 165/153 |
| 2004/0188076 | A1 * | 9/2004 | Lee | 165/174 |
| 2004/0256091 | A1 * | 12/2004 | Higashiyama | 165/153 |

FOREIGN PATENT DOCUMENTS

| | | | |
|---|---|---|---|
| DE | 43 13 567 | C1 | 9/1994 |
| WO | WO 02/48516 | A1 | 6/2002 |

* cited by examiner

*Primary Examiner*—Teresa J. Walberg
(74) *Attorney, Agent, or Firm*—Foley & Lardner LLP

(57) ABSTRACT

Disclosed is a heat exchanger, in particular for use in a motor vehicle, in addition to a circuit including a heat exchanger.

24 Claims, 11 Drawing Sheets

HEAT EXCHANGER

The invention relates to a heat exchanger, in particular for use in a motor vehicle, and to a circuit with a heat exchanger.

Heat exchangers are often used in a motor vehicle, for example as coolers, heating elements, condensers or evaporators. A modern vehicle has a multiplicity of various heat exchangers which are designed, for example, as coolers and cool different vehicle assemblies, vehicle components or media in vehicle assemblies or vehicle components. For example, a coolant cooler for cooling the engine, such as, for example, the internal combustion engine or electric motor, a transmission oil cooler, an exhaust gas cooler, a charge air cooler and a hydraulic oil cooler are provided for the most diverse possible applications in a vehicle and/or for further coolers.

The arrangement of a large number of heat exchangers in the vehicle necessitates an increased construction space requirement and repeatedly leads to conflicts between the existing construction space and the respective arrangement of the heat exchangers. In this case, this may result in certain compromises in terms of the arrangement of the individual heat exchangers which may possibly not be ideal for thermodynamic reasons. Also, an increased construction space requirement arises due to the individual arrangement of the respective heat exchangers, since, because of existing manufacturing tolerances, more construction space has to be made available than is possibly necessary.

The object of the invention is to provide a heat exchanger which is improved, as compared with the prior art.

This is achieved, according to the invention, in that a heat exchanger, in particular for motor vehicle cooling systems, is designed in such a way that it is provided with at least one fluid inlet and at least two fluid outlets, and with an arrangement of fluid connections between inlet, collecting, deflecting and/or outlet chambers, the fluid connections being subdivided into various regions, a first region of fluid connections being arranged between at least one inlet and one first outlet, and a further region of fluid connections being arranged between the first outlet and a second outlet.

It is particularly expedient if a further third outlet is arranged and a further region of fluid connections is provided between the second outlet and the third outlet. It may, however, also be expedient if a further nth outlet is arranged and a further region of fluid connections is provided between the n−1-th outlet and the nth outlet, n preferably being 3, 4, 5, 6, 7, 8, 9, 10 or greater than 10.

It is also advantageous if individual regions of fluid connections are connected to other regions of fluid connections and/or to at least one inlet and/or at least one outlet by means of inlet, collecting, deflecting and/or outlet chambers.

In this case, it is expedient if the inlet, collecting, deflecting and/or outlet chambers are arranged preferably in side boxes arranged laterally with respect to the fluid connections, the side boxes being capable of being subdivided into various chambers by means of partitions. In this case, it is advantageous if the partitions are designed as vertical, horizontal or l-shaped, z-shaped, c-shaped or T-shaped walls or as walls formed compositely from these.

In one exemplary embodiment, it is expedient if a deflection in depth, that is to say in a plane of the fluid connections, is present between at least one first region of fluid connections and one second region of fluid connections.

In a further exemplary embodiment, it is expedient if a deflection in width, that is to say in a plane perpendicular to a plane of the fluid connections, is present between at least one first region of fluid connections and one second region of fluid connections.

In a further exemplary embodiment, it is expedient if a deflection in depth and in width, that is to say in a plane of the fluid connections and in a plane perpendicular to a plane of the fluid connections, is present between at least one first region of fluid connections and one second region of fluid connections.

It is likewise advantageous if two regions of fluid connections are routed in countercurrent without an outlet between them.

Furthermore, it is expedient if ducts for a further medium or fluid are provided between the fluid connections. In this case, it may be particularly expedient if these ducts are formed by ribs between the fluid connections. The medium may advantageously be air. The medium may advantageously be a fluid or liquid medium.

It is expedient if the fluid connections are tubes, preferably such as flat tubes or round tubes or oval tubes. It is likewise expedient if the tubes have a plurality of fluid ducts which do not communicate with one another over the length of the tubes. Furthermore, it is expedient if the fluid connections or tubes have a plurality of fluid ducts which communicate with one another over the length of the tubes. Furthermore, it may be expedient if the fluid connections or tubes are arranged in a single row or in a plurality of rows next to one another for each plane of the fluid connections.

According to a further idea of the invention, a fluid circuit is provided, with at least one heat exchanger having at least one inlet and at least two outlets and with at least two assemblies which can be supplied by the heat exchanger by means of fluid lines and have a fluid inlet and a fluid outlet, characterized in that a pump with an inlet and outlet is arranged between one outlet of the at least one heat exchanger and one inlet of at least one assembly, and at least one outlet of a further assembly can be connected to the inlet side of the pump. What is advantageously achieved thereby is that the number of pumps used can be reduced and, at the same time, the fluid stream for cooling the further assemblies can also be used for cooling the main assembly, such as the vehicle engine. The efficiency of the cooling system is thus further increased. As a result, for example, the overall system can have a varied design and, where appropriate, structural parts and costs are saved or have smaller dimensioning.

What may be considered as assemblies of the vehicle are the engine, the transmission, a turbocharger, an injection pump, electronics, an exhaust system, hydraulic systems or further assemblies as heat sources. Where such heat sources are concerned, it is often necessary for heat to be discharged to the surroundings for purposes of cooling and of thermal control.

It is advantageous if the further assembly is connected with its inlet to an outlet of the heat exchanger. It is also expedient if a plurality of further assemblies are connected in series and have the fluid flowing through them. It is also advantageous if a plurality of further assemblies are connected in parallel and have the fluid flowing through them. It is particularly advantageous if the inlet of a further assembly is connected to an outlet of the heat exchanger.

The invention will be explained in more detail below by means of exemplary embodiments in the figures of which:

FIG. 1 shows a heat exchanger, such as, for example, a cooler, a heater, a condenser or an evaporator. The heat exchanger will be described below, without any restriction in generality, in terms of its function as a coolant cooler.

Figure 1:
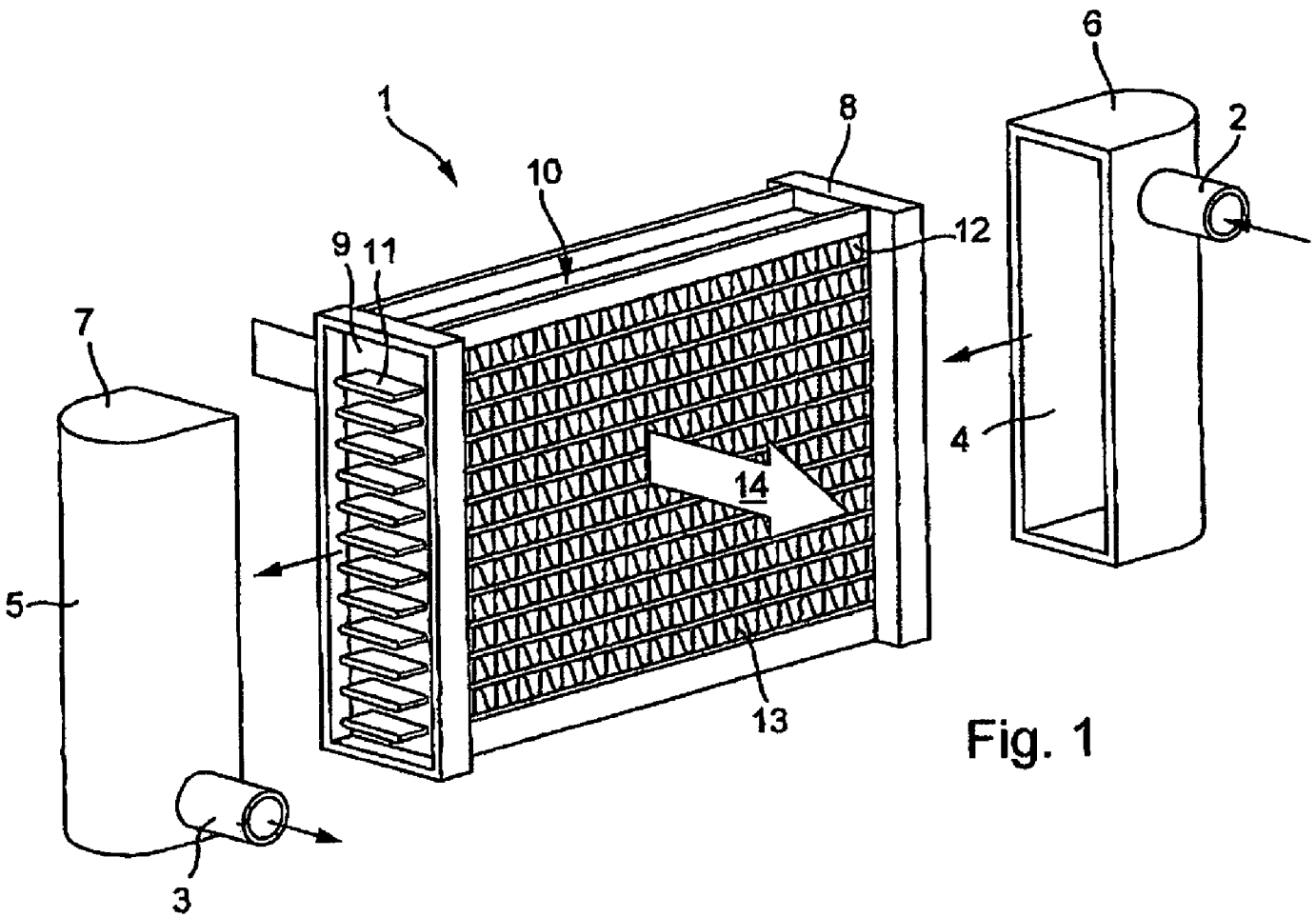
FIG. 1 shows a diagrammatic illustration of a heat exchanger.

The heat exchanger 1 has a fluid inlet 2 and a fluid outlet 3, so that a fluid can flow through the heat exchanger between the inlet and the outlet. The inlet is connected to a collecting chamber 4 and the outlet to a collecting chamber 5. The fluid flows from the inlet 2 into the first collecting chamber 4, an inlet-side collecting chamber. The fluid flows from the second collecting chamber 5, an outlet-side collecting chamber, into the outlet 3. In FIG. 1, the inlet-side collecting chamber 4 or the outlet-side collecting chamber is formed by a box-shaped element 6 or 7, such as, for example, a water box or fluid box, which can be connected to a wall, such as tube sheets, 8 or 9 and is designed to be outwardly fluidtight. The parts 6 and 8 on the inlet side and the parts 7 and 9 on the outlet side are connected to one another in such a way that the fluid located inside essentially cannot emerge.

Provided between the collecting chambers 4 and 5 are fluid connections 10, through which the fluid can flow from the one collecting chamber 4 to the other collecting chamber.

The fluid connection 10 consists essentially of a multiplicity of parallel tubes 11, through which the fluid can flow inside from one side to the other side. These tubes may be flat tubes or round tubes or other connecting tubes. These tubes may also have, inside them, various flow ducts which are formed separately from one another or which are also at least partially connected to one another at least in places. The tubes 11 are arranged in such a way that free spaces are provided as an air passage between them. Ribs 13 are preferably arranged in at least some of these free spaces 12, in order to form flow ducts for the air passage according to the arrow 14 and to improve heat exchange between the air and fluid passing through. The surface on the cooling-air side is thereby increased as effectively as possible.

The heat exchanger has the feature that the two participating media, for example the cooling air and the fluid, are led in cross current.

The tube sheets and water boxes or fluid box form chambers which, on the inlet side, serve for distributing the coolant stream or fluid stream to the tubes and, on the outlet side, for combining the coolant stream out of the tubes. The connections 2, 3, such as, for example, connection pieces on the chambers, make it possible to connect the heat exchanger to a fluid circuit, such as, for example, a coolant circuit.

FIG. 1 illustrates the cooler network in a form of construction preferably consisting of flat tubes and of corrugated ribs. The tubes may have the following forms of construction: round tube type of construction, oval tube type of construction or bundle type of construction.

Figure 2:
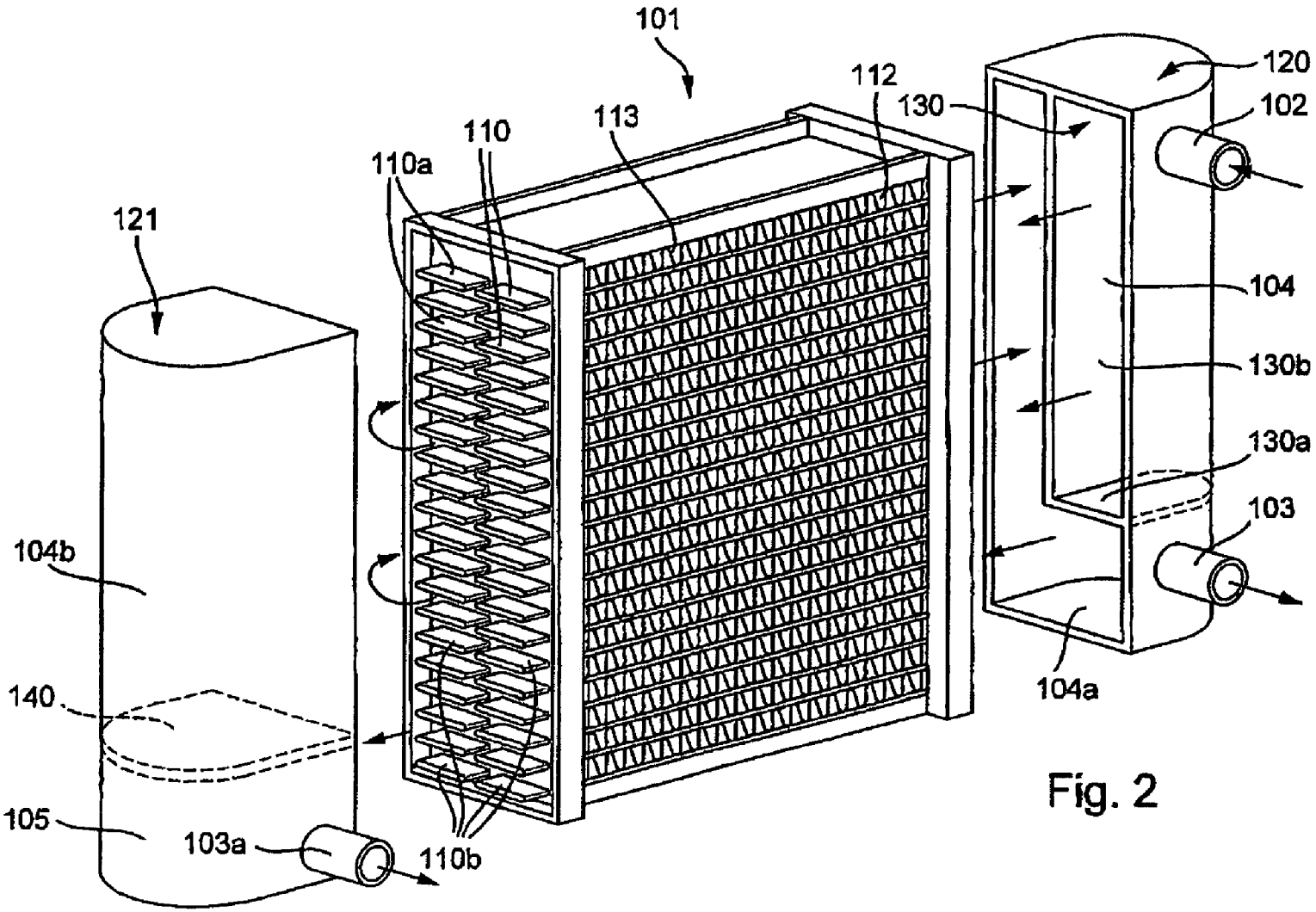
FIG. 2 shows a diagrammatic illustration of a heat exchanger.

FIG. 2 shows a diagrammatically illustrated heat exchanger 101 according to the invention which operates on the basis of cross current routing and/or cross countercurrent routing. Cross current routing means that the one fluid stream and the second fluid stream intersect. Cross countercurrent routing means that the one fluid stream and the second fluid stream intersect, the second fluid stream in this case also experiencing a deflection, so that both an outward and a returning fluid stream intersect with the first fluid stream, that is to say opposite fluid streams intersect with the other fluid stream.

The heat exchanger 101 has at least one first fluid inlet 102 and one first fluid outlet 103 and one second fluid outlet 103*a*, so that a fluid can flow through the heat exchanger 101 between the inlet 102 and the first or the second outlet. The inlet 102 is connected to a collecting chamber 104 and the first outlet to a collecting chamber 104*a* and the outlet is connected to a further collecting chamber 105. The fluid flows from the inlet 102 into the first collecting chamber 104, an inlet-side collecting chamber. The fluid flows from there through the fluid connections 110 into a further collecting chamber 104*b*, an intermediate chamber. The fluid is deflected in the intermediate chamber 104*b* and is led through the fluid connections 110*a*, counter to the direction of flow in the fluid connections 110, to the collecting chamber 104*a*. A first part of the fluid stream is branched off from the collecting chamber 104*a* through the one outlet 103 and is discharged into a fluid circuit. A further part of the fluid stream is led through a further part of the fluid connections 110*b* to the collecting chamber 105. The fluid emerges from the heat exchanger there and is supplied to a further fluid circuit or part circuit.

A design of the heat exchanger with a first stage, which is illustrated by the components 102, 104, 110, 104*b*, 110*a*, 104*a* and 103, is advantageous. This is a cross countercurrent heat exchanger. In this stage, where a coolant cooler is concerned, the fluid is already cooled to a first temperature. In the second stage, which is illustrated by the parts 104*a*, 110*b*, 105 and 103*a*, part of the fluid which, for example, has already been cooled in the first stage is cooled once again, so that this part of the fluid is cooled to a greater extent. The tubes are arranged, for example in the upper first region 110, 110*a*, one behind the other, as seen in the direction of flow of the second medium, so that the tubes or fluid connections 110, 110*a* are in each case arranged in pairs and preferably on one plane. In this case, two or more individual tubes may be arranged one behind the other, or there may be a single tube which has within its extent a multiplicity of fluid ducts which are appropriately interconnected so that some of the ducts represent the fluid connection 110 and some of the ducts represent and form the fluid connection 110*a*.

In the second region of the heat exchanger with the fluid connections 10*b*, individual tubes may also be used or a plurality of tubes, which are connected in parallel with respect to the fluid flow, may be used for each plane of the fluid connections. An individual tube or a plurality of tubes may also be arranged as a fluid connection, these tubes at least partially or also in each case again having individual fluid ducts.

The number of fluid connections 110, 110*a* belonging in each case to the first region and the number of fluid connections belonging to the second region may be designed according to size of the volume flow of the part volume flows and to the corresponding target temperature of the fluid of the part volume flows. Preferably, the first region from the inlet 102 to the first outlet 103 is the part region which has more fluid connections than the second part region of the fluid connections 110*b*. However, this may also be selected otherwise, depending on target temperature and volume flow.

The division of the volume flows into the part volume flows takes place, inter alia, in the collecting chambers. These are separated from one another in the outer boxes 120, 121 of the heat exchanger by means of walls. The first outer box 120 is constructed in such a way that it has a first partition 130 between the collecting chambers 104 and 104*a* which brings about fluidtight separation between these chambers.

The one chamber 104 is an inlet chamber which is delimited by the, for example, box-shaped outer wall of the outer box and by the wall 130. Furthermore, the chamber 104 is delimited by the wall 130 which has a first wall region 130*b*, oriented perpendicularly to the planes of the fluid connections 110, 110*a*, 110*b*, and a second wall region, which is oriented essentially parallel to the respective planes of the fluid connections 110, 110*a*, 110*b*.

The outer box 121 is separated inside it into two regions 104*b*, 105 by the partition 140, the partition 140 being oriented essentially parallel to the respective planes of the fluid connections. Thus, with the heat exchanger arranged vertically, the partition 140 is oriented horizontally, according to FIG. 2.

In the exemplary embodiment of FIG. 2, the region 104*b* serves as an intermediate chamber or deflecting or distributing chamber, the chamber 104 serving as an inlet chamber, the chamber 105 as an outlet chamber and the chamber 104*a* both as an outlet chamber and as an intermediate, distributing or deflecting chamber.

The outer or side boxes 120, 121 may preferably be produced from metal or plastic, in which case, in the plastic variant, the partitions 130, 140 may be formed as parts produced in one piece with the box. The box may in this case be capable of being produced as a whole as an injection molding.

In FIG. 2, the tubes 110, 110*a*, 110*b* are arranged in such a way that free spaces 112 are provided as an air passage between them. Ribs 113 are preferably arranged in at least some of these free spaces 112, in order to form flow ducts for the air passage and to improve heat exchange between the air and the fluid passing through. The surface on the cooling-air side is thereby increased as effectively as possible. In the case of a medium other than air, other ducts may also be provided, instead of an air passage.

The heat exchanger has the feature that the two participating media, for example the cooling air and the fluid, are routed in cross countercurrent in the first upper region of the fluid connections 110, 110*a*. In the lower region of the fluid connections, the two participating media are arranged in cross current.

The tube sheets and water boxes or fluid box form chambers which serve, on the inlet side, for distributing the coolant stream or fluid stream to the tubes and, on the outlet side, for combining the coolant stream out of the tubes. The connections 102, 103, 103*a*, such as, for example, connection pieces on the chambers, make it possible to connect the heat exchanger to a respective fluid circuit or part fluid circuit, such as, for example, a coolant circuit.

FIG. 1 illustrates the cooler network in a form of construction preferably consisting of flat tubes and corrugated ribs. The tubes may have the following forms of construction: round tube type of construction, oval tube type of construction or bundle type of construction.

The invention described here relates to fluid/fluid heat exchangers with cross current and/or cross countercurrent routing, to which one or more fluid streams are supplied at a high temperature level and from which two or more fluid streams cooled to different temperatures emerge.

Both liquids, gases or liquid/gas mixtures may be considered as fluid according to the present application documents.

In the configuration according to the invention, the heat exchanger preferably consists of a first single-row, double-row or multirow tube/rib system with distributing and collecting chambers, preferably at least part of the heat exchanger having at least one deflection in depth with cross countercurrent routing. A deflection essentially in a plane of the tubes or fluid ducts is to be understood as a deflection in depth. This deflection from the fluid connections 110 to the fluid connections 110*a* takes place in the chamber 104*b*. A further part of the heat exchanger may also have the flow passing through it only once or else in countercurrent, that is to say without or with deflection in depth.

In another exemplary embodiment, a deflection may also take place in width, the deflection in width being defined in such a way that the deflection is oriented essentially perpendicularly to the planes of the fluid ducts.

Instead of the fluid connections or tubes arranged in two or more rows, a single-row arrangement of tubes may also be used, these tubes then preferably having in their core a separation of various fluid ducts which correspondingly assume the function of the fluid connections shown in FIG. 2.

The tube/rib system may be a system with flat, oval or round tubes or else be a system with other cross-sectional forms. The system may be assembled mechanically or soldered. The tube/sheet connection may be made by mechanical forming, soldering, welding or adhesive bonding. The tube/rib system and the distributing and collecting chambers may be composed, for example, of the following materials, in particular of aluminum, nonferrous metal, steel or plastic.

In the configuration according to the invention, the heat exchanger is subdivided into two or more regions by partitions in the collecting chambers, for example one region representing the cooler of a main coolant circuit, and one or more further regions having the function of low-temperature coolers or other coolers. The flow routing through the regions of the heat exchanger is determined by the partitions into the distributing and collecting chambers and by connection pieces on the distributing and collecting chambers. Each cooler region thus defined may have intrinsically deflections in width or in depth.

These additional deflections are implemented by means of additional partitions in the distributing and collecting chambers.

To form the chambers, the partitions in the boxes are arranged or oriented straight, preferably horizontally or vertically, but, in other exemplary embodiments, it may also be expedient if they have in section an l-shaped, z-shaped, T-shaped and/or U-shaped form or else another composite form.

In a preferred refinement, a fluid, such as, for example, a coolant, enters a heat exchanger having two or more tube rows 110, 110*a* through only one connection piece 102, specifically into the region which constitutes the cooler of the main coolant circuit. Furthermore, the heat exchanger has outlet connection pieces 103, 103*a*, specifically in each case one for the region of the cooler of the main coolant circuit and one for each low-temperature cooler region. This is associated with a cascading of the fluid stream, such as, for example, the coolant stream, that is to say, at each outlet connection piece, only part of the fluid stream or coolant stream emerging from the respective cooler region is led out, the rest constituting the fluid stream or coolant stream entering the following cooler region.

The low-temperature regions in an integrated heat exchanger are preferably arranged in such a way that regions through which coolant of higher temperature flows lie, in the cooling-air stream, behind or next to regions through which coolant of lower temperature flows.

The fluid-side or coolant-side inlet cross sections in the regions are advantageously, where appropriate, likewise stepped according to the cascading of the fluid stream or of the coolant stream. In this case, the stepping of the size of the inlet cross sections is to be selected such that the flow velocity of the coolant, on the one hand, does not fall so sharply that the performance of the region is impaired and, on the other hand, does not rise so sharply that the pressure loss becomes excessively high. Preferably, the stepping of the size of the inlet cross sections is selected such that the inlet cross section of the following region of the heat exchanger or cooler region amounts to between ⅕ and ½ of the outlet cross section of the preceding region of the heat exchanger or cooler region. In further exemplary embodiments, the inlet cross section may amount even only to ⅒ of the outlet cross section of the preceding region or may even be equal to it. It is advantageous, moreover, if the stepping of the size of the inlet cross sections is selected such that the flow velocity of the fluid or of the coolant is approximately equal in all regions. In particular, it is beneficial if the flow velocity of the coolant in a following cooler region amounts to between 0.8 times and 1.2 times the flow velocity of the coolant in the preceding cooler region.

In the first preferred configuration, the flow routing of the coolant through the regions of the cooler is selected such that all the connection pieces may be arranged as simple connection pieces arranged on the cooler rear side. In a further exemplary embodiment of the invention, at least individual connection pieces could be arranged as an inlet or outlet both on the cooler rear side or on the side or, if appropriate, also on the cooler front side. The cooler rear side is in this case defined as being the side which, with the cooler installed in the vehicle, points in the direction of the engine space.

FIG. 3 shows once again an exemplary embodiment of a heat exchanger 200 according to FIG. 2 in a diagrammatic illustration. The fluid or else the coolant enters the first region 202 of the cooler through the inlet 201. The fluid flows from there through the fluid connections 203 into the region 204. This region 204 is designed as a chamber and has a deflection in depth, that is to say essentially in the plane of the fluid connections. The fluid is led from the region 204 into the fluid connections 205. The fluid flows from there into the chamber 206. This chamber has, on the one hand, a deflection in width, since the fluid is led to the lower region of the chamber and is partially discharged there through the outlet 207 and, on the other hand, is partially routed through the fluid lines 208. The region 208 constitutes a low-temperature region without deflection in depth. The fluid flows from there in the region 209 and then through the outlet 210. As a result, the outlet connection piece of the first cooler region can be mounted on the chamber on the cooler rear side at the point where the inlet into the low-temperature region is located. The throughflow is cascaded, that is to say part of the coolant emerges downstream of the first cooler region and the other part enters the following low-temperature region.

Figure 3:
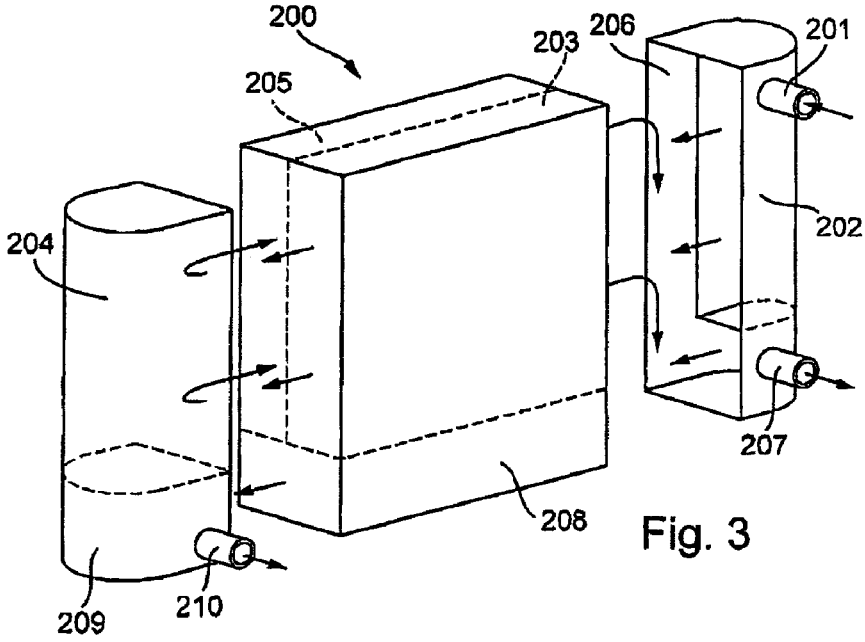
FIG. 3 shows a diagrammatic illustration of a heat exchanger.
Figure 4:
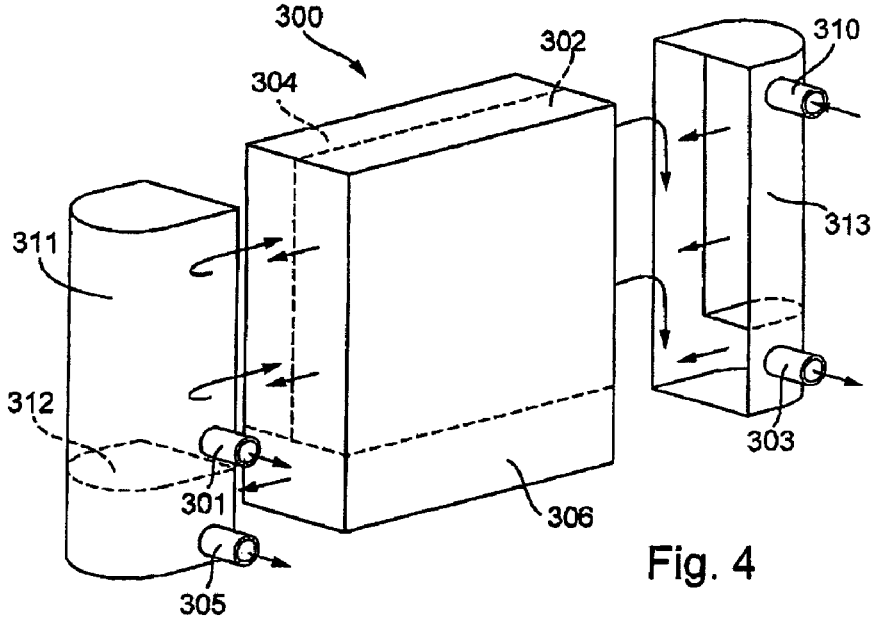
FIG. 4 shows a diagrammatic illustration of a heat exchanger.

FIG. 4 shows a heat exchanger in a diagrammatic illustration, parts of the heat exchanger 300 of FIG. 4 not being described again, insofar as they are already illustrated in FIG. 2 or 3. The heat exchanger 300 has, in addition to the inlet connection piece 310 and the outlet connection pieces 303 and 305, a further outlet connection piece 301. This gives rise to a further low-temperature region of the heat exchanger. This low-temperature region of the heat exchanger arises in the region 302, the region 304 constituting a further low-temperature region. The heat exchanger thus has three respective regions 302, 304 and 306 which are assigned in each case an outlet 301, 303 and 305, with only one inlet 310. The flow passage through each of the three cooler regions is simple. A deflection in depth, preferably in the chamber 311, takes place from the region 302 to the region 304. The intermediate walls 312, 313 of the chambers are arranged, at 312, horizontally and, at 313, so as to be l-shaped in section, with a long leg in the vertical and a short leg in the horizontal. As regards the partitions, however, other variants may also be advantageous, depending on the configuration of the chambers of the side boxes.

Figure 5:
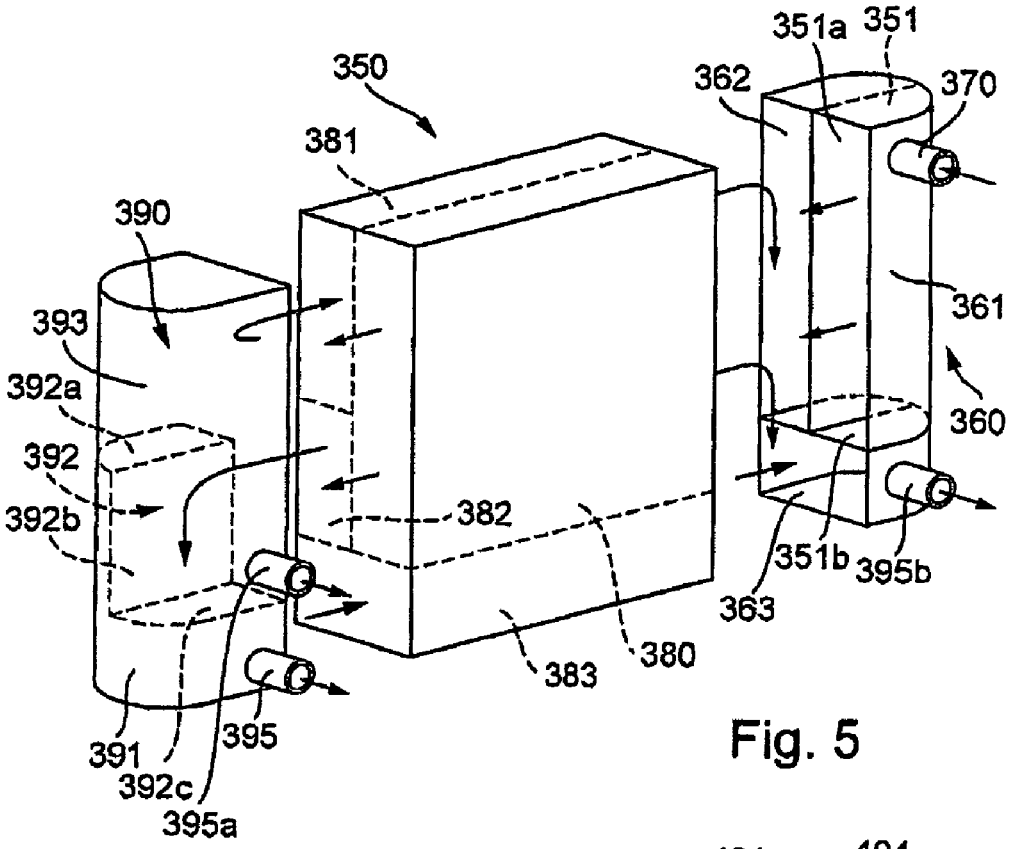
FIG. 5 shows a diagrammatic illustration of a heat exchanger.

FIG. 5 shows a heat exchanger 350 in a diagrammatic illustration, parts of the heat exchanger 350 of FIG. 5 not being described again, insofar as they are already illustrated in FIGS. 1 to 4. The heat exchanger 350 of FIG. 5 has, in the first side box 360, a T-shaped intermediate wall 351 consisting of a horizontal wall 351*b* and of a vertical wall 351*a* which essentially stands on the horizontal wall. By virtue of this configuration of the intermediate wall 351, the side box 360 is divided into three regions 361, 362, and 363, two regions on both sides of the wall 351*a* and one below the wall 351*b*.

The heat exchanger 350 has, in the second side box 390, an essentially z-shaped intermediate wall 392 consisting of a horizontal wall 392*a*, and a vertical wall 392*b* and a further horizontal wall 392*c*. By virtue of this configuration of the intermediate wall 392, the side box 390 is divided into two regions 391 and 393.

The region 361 is connected to the inlet 370. Starting from the region 361, the fluid flows through the fluid connections of the region 380. The fluid flows from there into the region 393, is deflected there both in depth and, if appropriate, in width and flows from there at least partially into the region 381. A further part flows out through the outlet 395*a*. The fluid stream which flows through the region 381 is deflected in depth in the region 362 and then flows through the region 382 back into the region 391. A further part of the fluid flows out of the region 391 from the outlet 395, and another part flows through the region 383 after a deflection in depth in the region 391. The fluid flows from the region 383 into the region 363 and from there through the outlet 395*b*. The heat exchanger thus consists of a first cooler region and of two further following coolers, a deflection in depth, that is to say in the plane of the fluid connections, being present in the region of the second cooler, and, furthermore, the latter also having a deflection in width. The regions 380, 381, 382 and 383 of the fluid connections are arranged in such a way that the regions 381 and 382 are preferably arranged in front of the region 230 in the air flow direction, and the region 383 is arranged below these regions.

Figure 6:
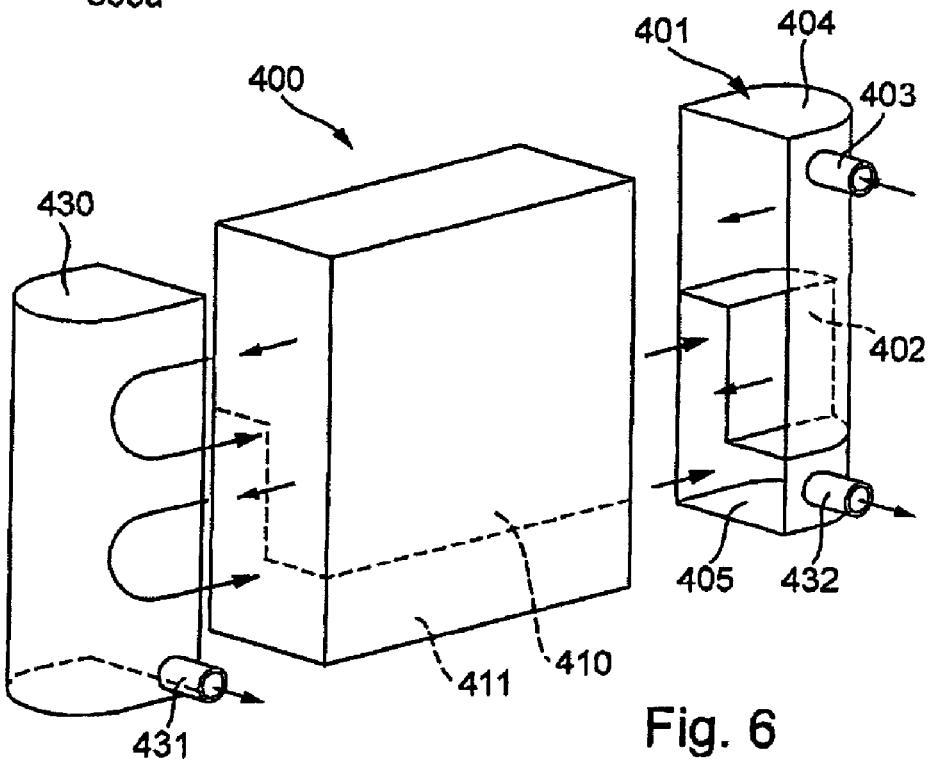
FIG. 6 shows a diagrammatic illustration of a heat exchanger.

The heat exchanger 400 according to FIG. 6 constitutes a further embodiment, which differs from the variant according to FIG. 3 in that the low-temperature region is located partially in front of the first cooler region with respect to the cooling-air stream. The intermediate wall 402 of the side box 401 is of z-shaped design, so that the fluid stream flows from the inlet 403 into the region 404. This region is formed, in the upper region, over the width of the side box and in the lower region has a restriction in extent due to division by the vertical intermediate wall. The fluid connections of the central region are likewise divided into the regions 410 and 411 by means of a z-shaped division. The fluid, starting from the chamber 404, flows through the region 410 into the side box 430, is partially deflected there in depth and in width and partially flows out through the outlet 431 and into the region 411 and from there into the region of the side chamber 405 and from there through the outlet 432. Part of the region 411 of the second cooler lies with its fluid connections in front of part of the cooler of the first region 410 in the direction of the air stream. The regions 410 and 411 are of 1-shaped design in section.

Figure 7:
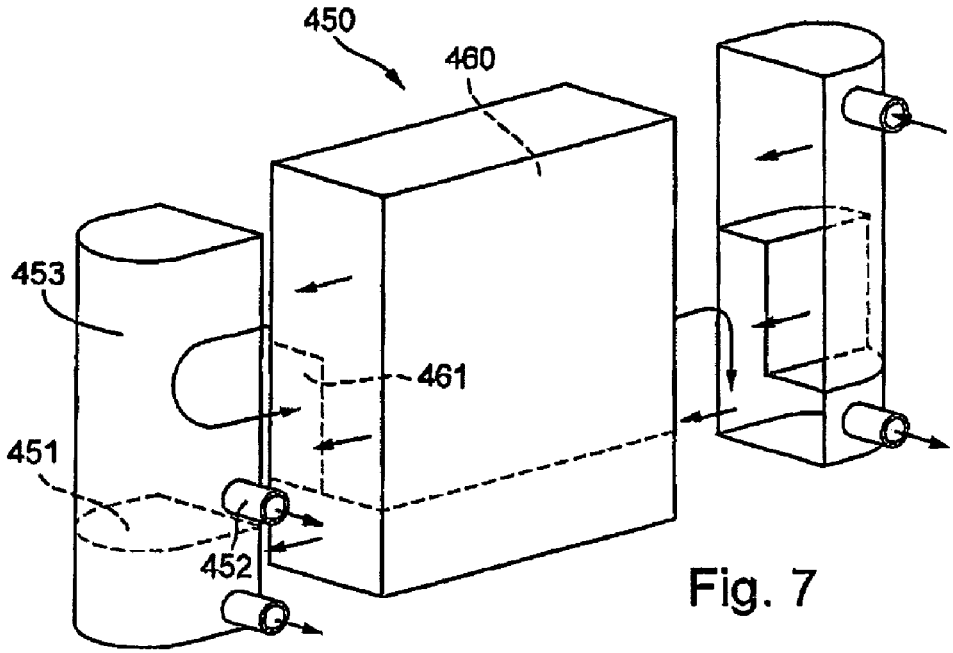
FIG. 7 shows a diagrammatic illustration of a heat exchanger.

FIG. 7 illustrates a design variant of a heat exchanger 450 which, as compared with the heat exchanger of FIG. 6, has a horizontal intermediate wall 451 in the one side box and a further outlet 452 in the region of the chamber 453. As a result, the fluid stream is both deflected from the region 460 into the region 461 and routed into the outlet 452. The fluid then flows from the region 461 into the chamber of the side box according to FIG. 6. A deflection in width takes place, starting from the region 461, in the region of the side box. The low-temperature region of the heat exchanger of FIG. 6 is thus divided into two low-temperature regions by means of an additional partition and an additional connection piece. The region 460 is l-shaped in section.

Figure 8:
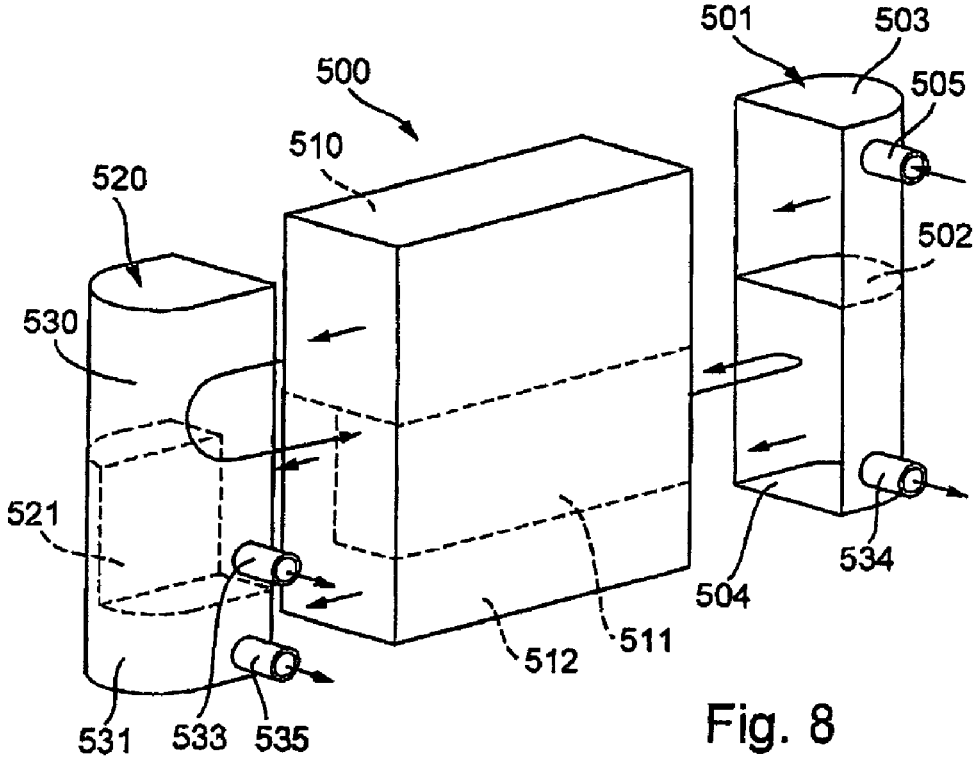
FIG. 8 shows a diagrammatic illustration of a heat exchanger.

FIG. 8 shows a further exemplary embodiment of a heat exchanger 500, the side boxes being interchanged in terms of the arrangement and form of the intermediate walls, as compared with FIG. 7, that is to say an intermediate wall 502 being arranged in a horizontal orientation in the first side box 501, and the side box 501 being divided into two regions, such as chambers, 503 and 504 which are arranged essentially one below the other. A z-shaped intermediate wall 521 is arranged in the second side box 520 and divides the side box 520 into two regions 530 and 531 which are essentially l-shaped in section.

The region 503 is connected as an upper chamber to the inlet 505. The fluid flows from there through the fluid connection region 510 which is designed as an arrangement of fluid connections which is parallelepiped in section. The fluid flows from there in a deflection in width and in depth into the region 511 which is designed as an arrangement of fluid connections which is parallelepiped in section. The fluid also flows out of the region 530 through the outlet 533. The fluid also flows through the region 511 and from there into the region of the chamber 504, where a deflection in depth and, if appropriate, in width takes place, part of the fluid in the chamber 504 flowing out through the outlet 534 and flowing further on through the region 512 which is designed as an arrangement of fluid connections which is l-shaped in section. The fluid flows from there into the chamber 531 and from there through the outlet 535. The heat exchanger of FIG. 8 constitutes a design variant which differs from the heat exchanger according to FIG. 6 in that, by means of a variation in the partitions and an additional connection piece, a further low-temperature region is divided off from the first cooler region.

Figure 9:
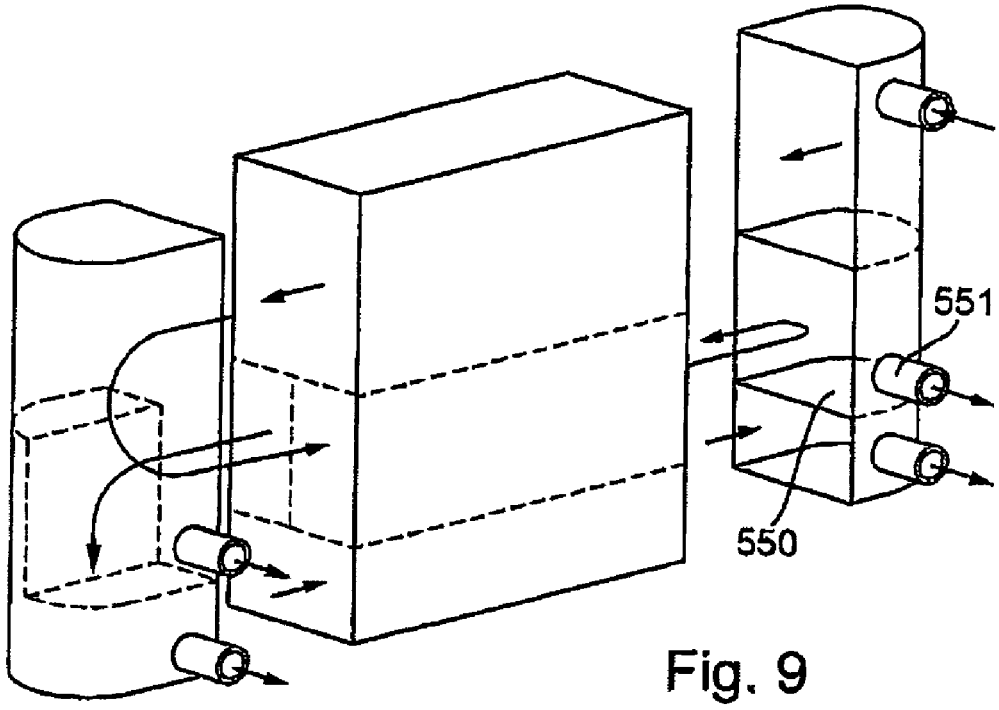
FIG. 9 shows a diagrammatic illustration of a heat exchanger.

FIG. 9 shows a design variant which differs from the heat exchanger of FIG. 8 in that the second low-temperature region is divided into two low-temperature regions by means of an additional horizontal partition 550 and an additional connection piece 551.

The heat exchangers of FIGS. 2 to 8 have a cascaded throughflow and, at least for a part stream, a deflection in depth.

Figure 10:
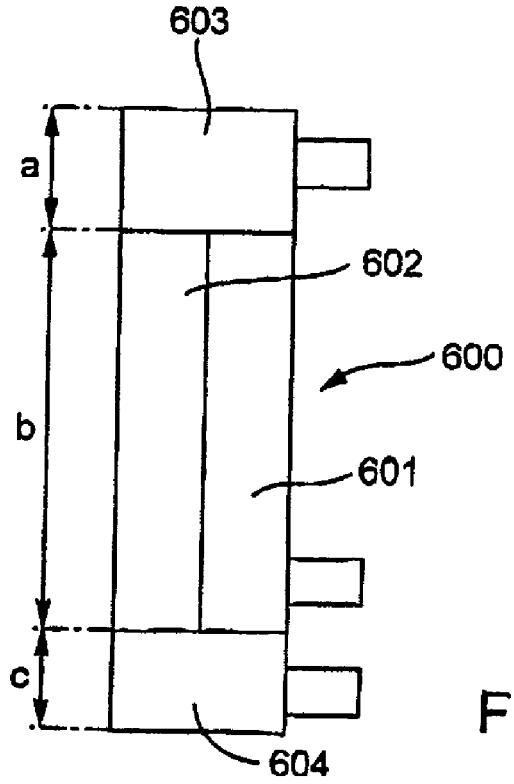
FIG. 10 shows a diagrammatic illustration of a heat exchanger.

FIG. 10 shows a section through a heat exchanger in the vertical direction, for example vertically in relation to a plane of the fluid connections. The tube/rib system 600 of the fluid connections is in this case designed, in the central region, at least in two rows with the fluid connection regions 601 and 602. This is expedient for the arrangement of the individual regions of the coolers, at least a partial deflection in depth being provided.

The deflection may take place, for example, in the side boxes which are not illustrated here. The deflection in depth is designed preferably in cross countercurrent. The integrated heat exchanger is subdivided into four regions 601, 602, 603 and 604, and each part region may have one or more tube rows. Each part region may have a simple throughflow or a deflection in width or in depth. In some exemplary embodiments, the part region 603 can be dispensed with. It is also possible to combine the part regions 603 and 601 and the part regions 602 and 604 into one region in each case. The dimensions a, b and c transverse to the throughflow direction of the integrated heat exchanger may be varied within defined limits. In this case, the sum a+b+c corresponds to the overall dimension of the heat exchanger. A possible value of the dimensions a, b and c could be given, for example, by the inside diameter of the assigned connection piece or connection pieces. If the part region 603 is omitted, a=0. The part region 604 is expediently present and, if appropriate, without deflection in depth.

In a further preferred configuration of a heat exchanger, the flow routing of the coolant through the regions of the cooler is selected such that the large part of the connection pieces can be arranged as simple connection pieces arranged on the cooler rear side, whereas other connection pieces are arranged otherwise and, for example, are led out from the distributing and collecting chambers laterally or on the front side. Different variants of this configuration are illustrated in FIGS. 11 to 14.

Figure 11:
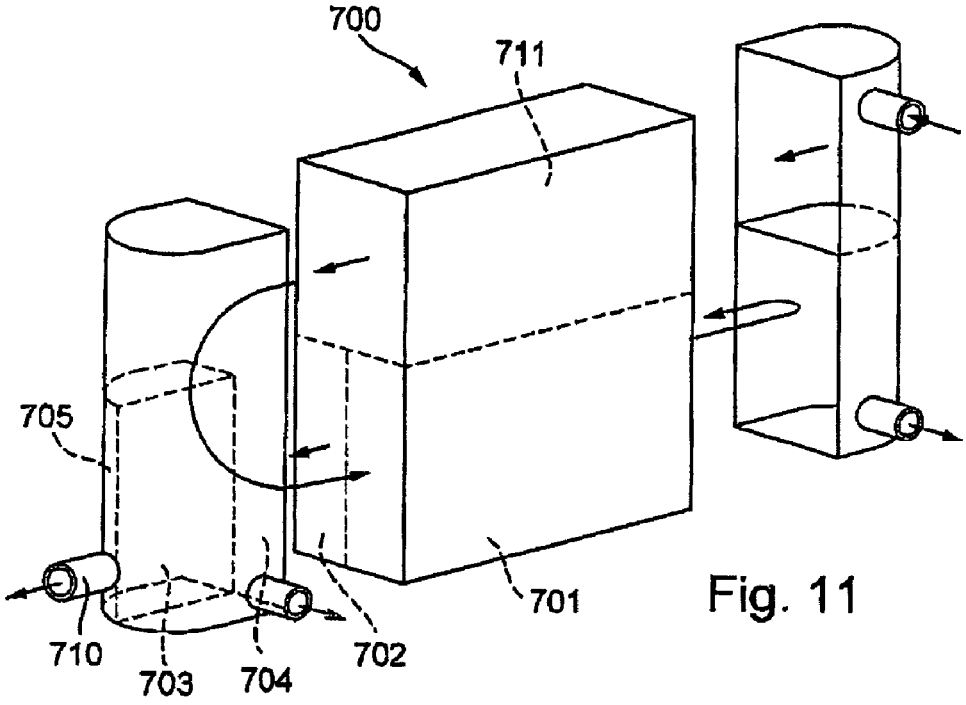
FIG. 11 shows a diagrammatic illustration of a heat exchanger.

The heat exchanger 700 of the exemplary embodiment of FIG. 11 constitutes essentially a variant which differs from the heat exchanger according to FIG. 8 in that the two low-temperature regions 701 and 702 are of equal size and, as a result, the second low-temperature region is located not only partially, but entirely in front of the first low-temperature region. Furthermore, the wall 703 is of l-shaped design and divides the side box into two chambers or regions 704 and 705, the region 705 lying at least partially in front of the region 704 in the air flow direction. Connected to the region 705 is an outlet 710 which may be directed toward the side or forward.

Figure 12:
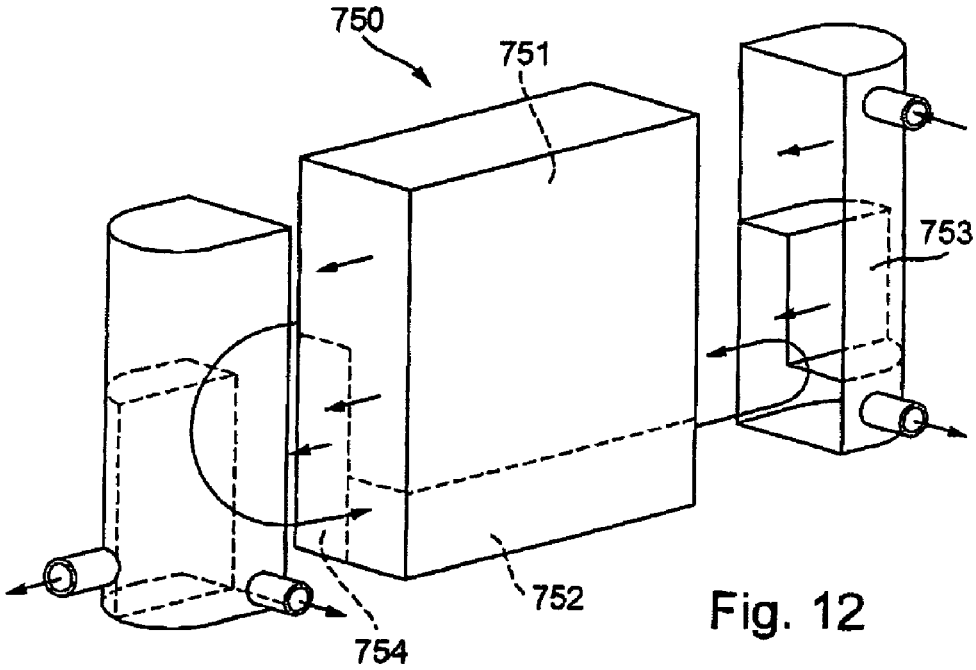
FIG. 12 shows a diagrammatic illustration of a heat exchanger.

The heat exchanger 750 of the exemplary embodiment of FIG. 12 constitutes essentially a further variant which differs from the heat exchanger according to FIG. 11 in that the main region 751 is larger than the main region 711 and the one low-temperature region 752 is smaller than the low-temperature region 701. This is achieved in that the fluid connections are connected correspondingly and the wall 753 is of z-shaped design in section. The main region 751 thus lies partially next to or behind the region 754 and above the region 752, as seen in the air flow direction. The two low-temperature regions 752 and 754 are of different size, and the second low-temperature region 754 is located partially in front of the main region 751 and in front of the low-temperature region 752.

Figure 13:
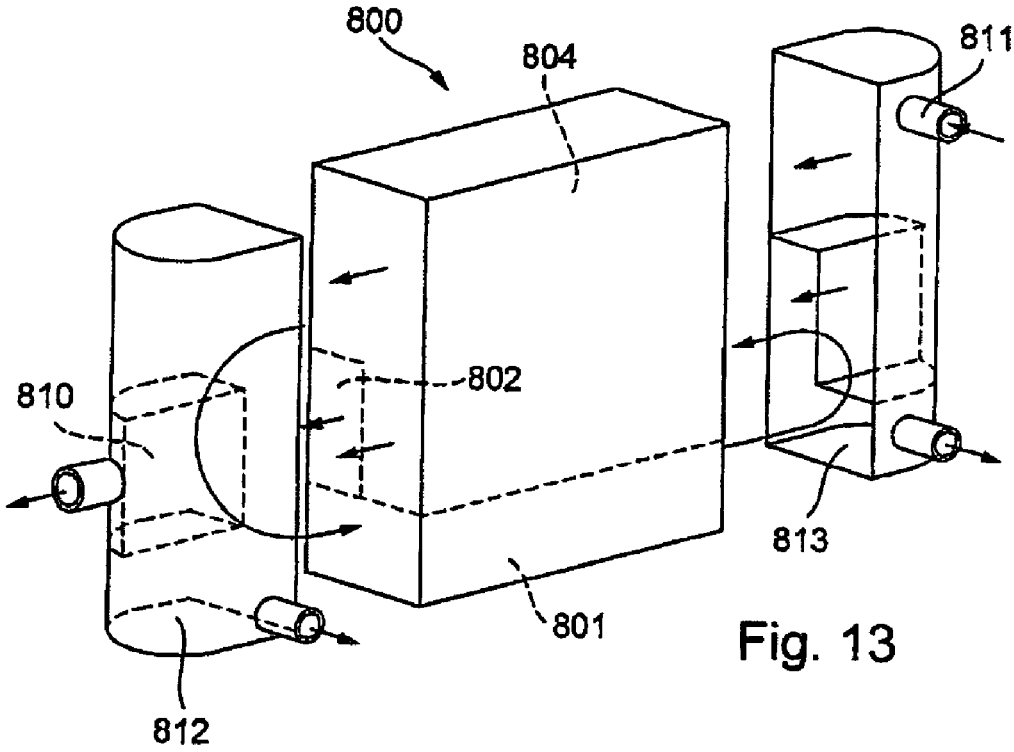
FIG. 13 shows a diagrammatic illustration of a heat exchanger.

The heat exchanger 800 of the exemplary embodiment of FIG. 13 constitutes essentially a further variant which differs from the heat exchanger according to FIG. 12 in that the one low-temperature region 801 is larger than the low-temperature region 752, and the low-temperature region 802 is smaller than the low-temperature region 754. This is achieved in that the fluid connections are interconnected correspondingly and the wall 810 is of c-shaped design and is formed essentially from two horizontal walls with one vertical wall. The main region 804 thus lies partially behind the region 802 and above the regions 802 and 801, as seen in the air flow direction. The low-temperature region 802 lies above the region 801. The region 802 is thus arranged between the region 801 and 804, the region 801 being partially directly adjacent to the region 804. The two low-temperature regions 801 and 802 are of different size. The heat exchanger 800 of FIG. 13 constitutes a variant of the heat exchanger of FIG. 7 which differs from the latter in that the sequence of throughflow of the two low-temperature regions 801, 802 is interchanged. This means that, starting from the inlet connection piece 811, the flow passes first through the region 804, then through the region 801 and subsequently through the region 802, a corresponding deflection of the fluid stream taking place in the chambers 812 and 813.

Figure 14:
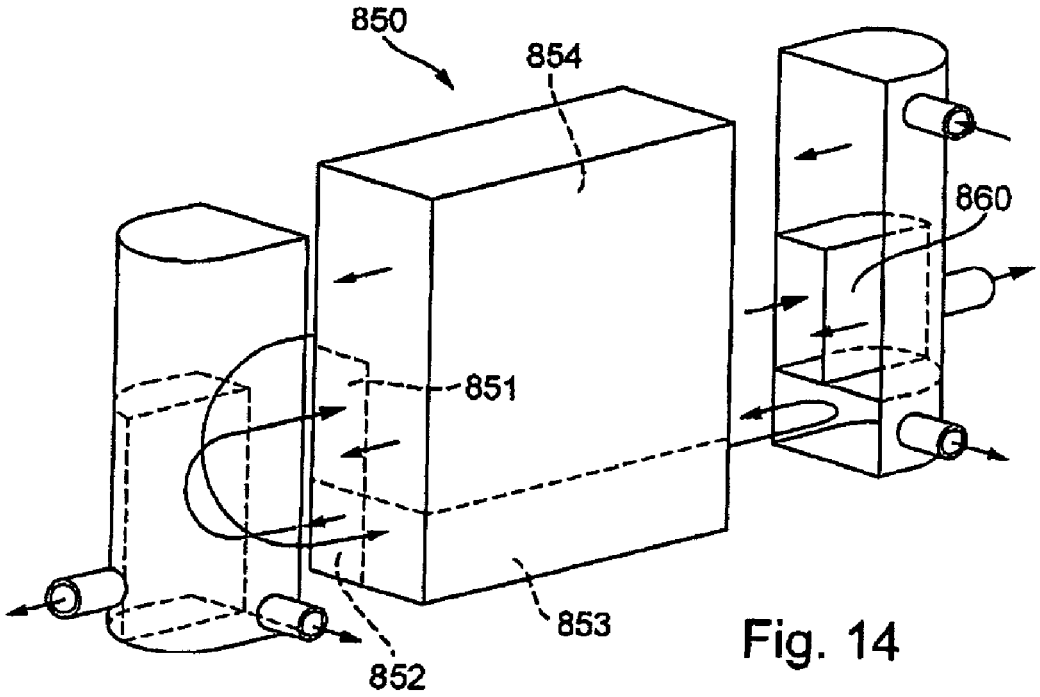
FIG. 14 shows a diagrammatic illustration of a heat exchanger.

The heat exchanger 850 of the exemplary embodiment of FIG. 14 constitutes essentially a further variant which differs from the heat exchanger according to FIG. 12 in that the one low-temperature region 754 is divided as a result of a further division into two low-temperature regions 851, 852, so that, overall, there are three low-temperature regions 851, 852, 853.

This is achieved in that the fluid connections are interconnected correspondingly and the wall 860 is of h-shaped design and is formed essentially from two horizontal walls with one vertical wall, the lower horizontal wall extending over the width of the side box and the upper horizontal wall extending only over a part region of the width of the side box. The main region 854 thus lies partially behind the region 851 and above the regions 852 and 853, as seen in the air flow direction. The low-temperature region 851 lies above the region 852. The region 853 is arranged in front of the region 852 in the air flow direction.

Figure 15:
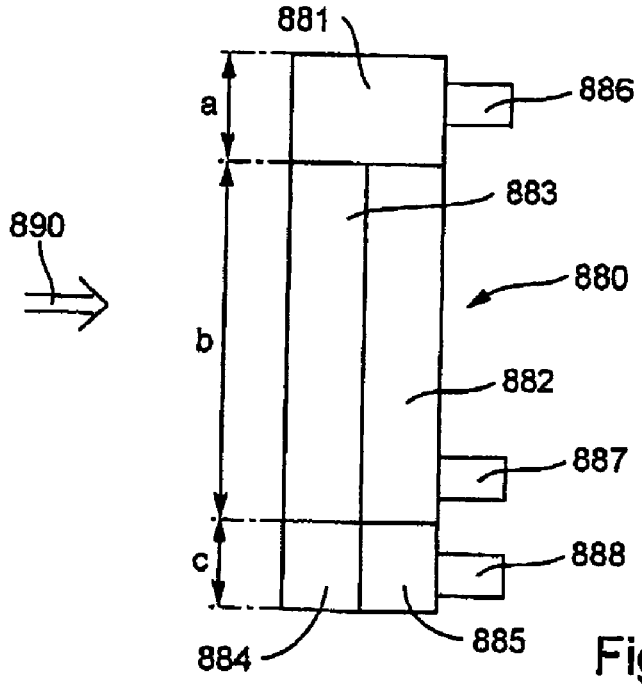
FIG. 15 shows a diagrammatic illustration of a heat exchanger.

The illustration of FIG. 15 shows a section through a heat exchanger 880 in the vertical direction. The tube/rib system is at least partially of at least two rows, an at least partial deflection in depth being provided. The deflection in depth may in this case be designed in cross countercurrent.

The integrated heat exchanger is subdivided into regions 881, 882, 883, 884 and 885 of fluid connections, and each part region may have one or more tube rows. Each part region may have a simple throughflow or a deflection in width and/or in depth. Optionally, for example, the part region 884 and/or 885 could be dispensed with. It is also possible to combine the part regions 881 and 882 and the part regions 883 and 885 into one region in each case. The dimensions a, b and c transverse to the throughflow direction 890 of the integrated heat exchanger may be varied according to the invention. In this case, the sum a+b+c is advantageously the overall dimension of the heat exchanger. A minimum of each of the dimensions a, b and c is given, where appropriate, by an inside diameter of the assigned connection piece or connection pieces. If the part regions 884 and 885 are omitted, c=0. The part region 881 is preferably present and, if appropriate, with/without deflection in depth.

Figure 16:
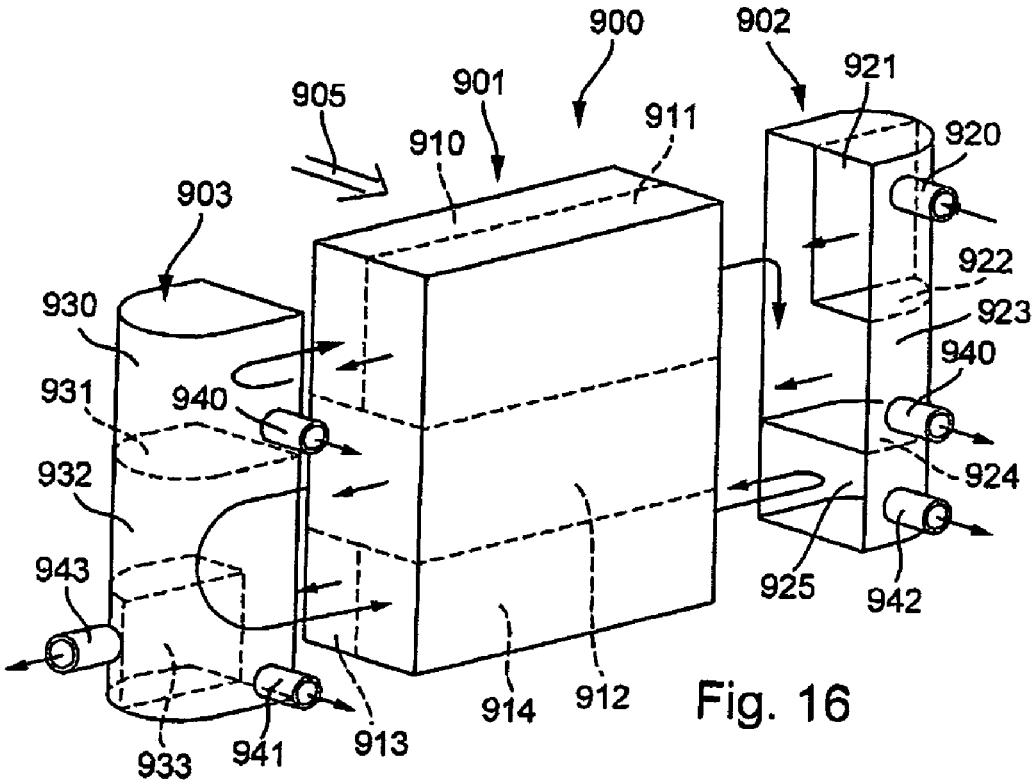
FIG. 16 shows a diagrammatic illustration of a heat exchanger.

FIG. 16 shows a heat exchanger 900 which is equipped with a tube/rib system by means of a central region 901 which is divided into different regions. Furthermore, the heat exchanger has laterally arranged side boxes 902 and 903, the side boxes being subdivided into individual chambers as a result of the arrangement of intermediate walls. Some of the chambers are in this case connected to at least one inlet and/or at least one outlet.

The central region 901 is subdivided into five separate regions of fluid connections, the regions, in each case considered separately, having parallel-connected fluid connections which are not connected to fluid connections of the other regions within the regions. As seen in the air flow direction, two regions 910, 911 are arranged at the upper end of the heat exchanger 900, the region 910 being arranged in front of the region 911 in the air flow direction. The two regions, while having essentially the same extent in depth, share the construction depth of the heat exchanger. In this respect, there may also be different extents in depth and, if appropriate, also in width. Below these two regions is arranged a third region 912 which extends over the entire depth of the heat exchanger. Below this region, two further regions 913, 914 are arranged at the lower end of the heat exchanger 900, as seen in the air flow direction, the region 913 being arranged in front of the region 914 in the air flow direction. The two regions, while having essentially the same extent in width, share the construction depth of the heat exchanger. In this respect, there may also be different extents in depth and, if appropriate, also in width.

The fluid flows through the inlet 920 through the connection piece into the chamber 921 which is formed in the side box by the wall 922 and by the wall of the side box. The fluid subsequently flows through the region 911 and is deflected at least partially in depth in the chamber 930. The chamber 930 is formed by the wall of the side box 903 and by the intermediate wall 931. Furthermore, part of the fluid flows out through the outlet 940. The fluid which is deflected in the chamber 930 subsequently flows back through the region 910 and enters the chamber 923 which is formed by the wall 922 and by the horizontal wall 924 in the side box 902. In the region of the chamber 923, the fluid is partially deflected in width, so that it flows into the region 912, and another part of the fluid emerges at the outlet 940.

The fluid which flows through the region 912 passes from there into the chamber 932, is partially deflected again there and flows partially into the region 914. Another part can flow out through the outlet 941. The fluid which flows through the region 914 enters the chamber 925 which is formed by the wall of the side box and by the horizontal intermediate wall. In this chamber, the fluid is partially deflected in depth and the fluid partially flows through the outlet 942. The defected fluid then flows through the region 913 and passes from there into the chamber 933 where it flows out through the outlet 943. The heat exchanger thus has one inlet and four outlets. This results, overall, in an integrated heat exchanger in which a large part of the connection pieces could be arranged on the cooler rear side, while other connection pieces are or may be arranged otherwise and, for example, are led out of the distributing and collecting chambers laterally or from the front. In this configuration, a plurality of part regions can be produced, which may in each case have one or more tube rows. Each part region may have a simple throughflow or a deflection in width and/or in depth.

In a further preferred configuration, the heat exchanger has more than one inlet. A "cascaded" throughflow of all the cooler regions supplied with coolant from a single inlet connection piece is therefore replaced by the mutually independent coolant supply of individual part regions or groups of part regions. This configuration can be produced from all the configurations and variants described above by means of additional partitions and connection pieces.

Figure 17:
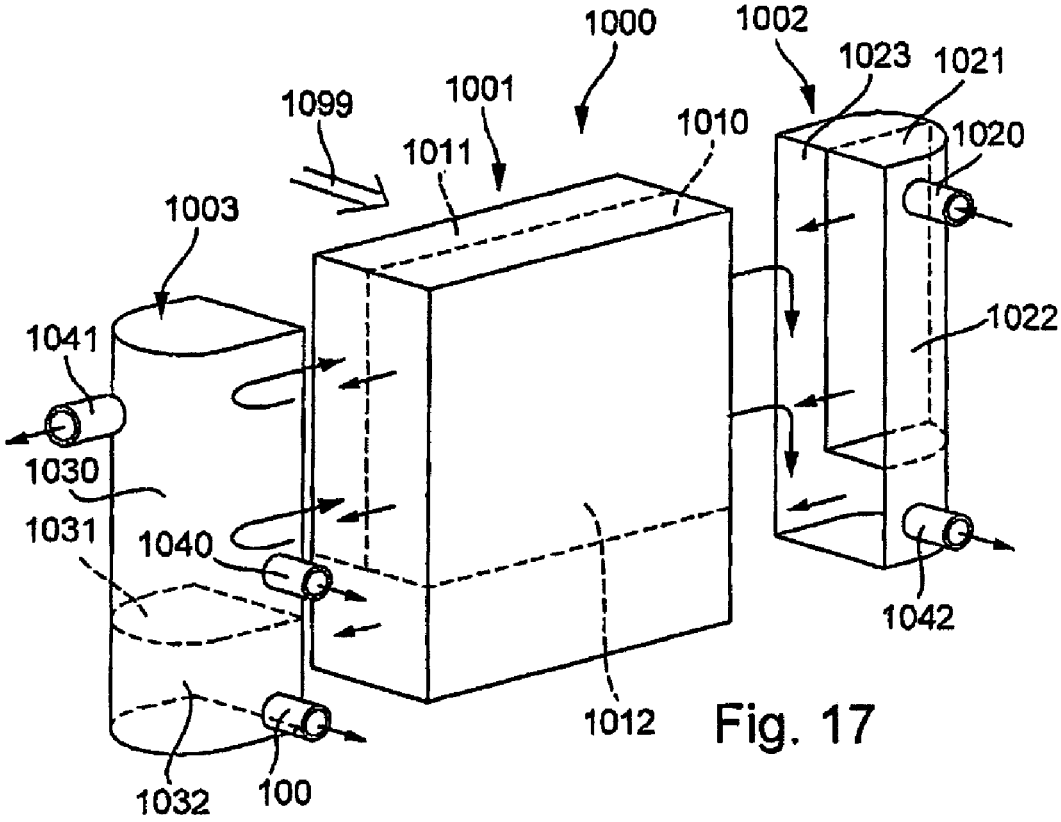
FIG. 17 shows a diagrammatic illustration of a heat exchanger.

FIG. 17 shows a further diagrammatic illustration of a heat exchanger 1000, in which two inlets are provided and, furthermore, three outlets. FIG. 17 shows a heat exchanger 1000 which is equipped with a tube/rib system by means of a central region 1001 divided into different regions. Furthermore, the heat exchanger has laterally arranged side boxes 1002 and 1003, the side boxes being subdivided into individual chambers as a result of the arrangement of intermediate walls. Some of the chambers are in this case connected to at least one inlet and/or at least one outlet.

The central region 1001 is subdivided into three separate regions of fluid connections, the regions, in each case taken separately, having parallel-connected fluid connections which are not connected to fluid connections of the other regions within the regions. Two regions 1010, 1011 are arranged at the upper end of the heat exchanger 1000, as seen in the air flow direction 1099, the region 1010 being arranged in front of the region 1011 in the air flow direction. The two regions, while having essentially the same extent in width, share the construction depth of the heat exchanger. In this respect, there may also be different extents in depth and, if appropriate, also in width. Below these two regions is arranged a third region 1012 which extends over the entire depth of the heat exchanger.

The fluid flows through the inlet 1020 through the connection piece into the chamber 1021 which is formed in the side box by the wall 1022 and by the wall of the side box. The fluid subsequently flows through the region 1010 and is deflected at least partially in depth in the chamber 1030. The chamber 1030 is formed by the wall of the side box 1003 and by the intermediate wall 1031. Furthermore, part of the fluid flows out through the outlet 1040. Further fluid flows through a further inlet 1041 into the chamber 1030. The fluid which is deflected in the chamber 1030 or which flows into the chamber through the further inlet subsequently flows back through the region 1011 and enters the chamber 1023 which is formed by the wall 1022 and by the wall of the side box 1002. In the region of the chamber 1023, the fluid is partially deflected in width, so that it flows into the region 1012, and another part of the fluid emerges at the outlet 1042.

The fluid which flows through the region 1012 passes from there into the chamber 1032 and flows from there out through the outlet 941. The heat exchanger thus has two inlets and three outlets.

Figure 18:
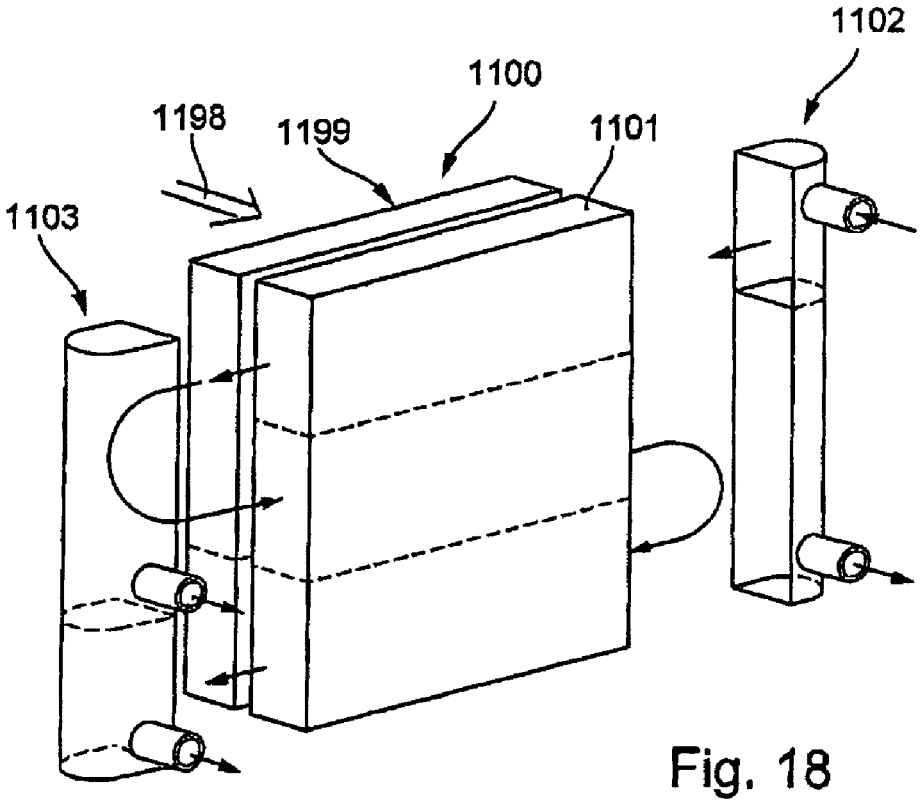
FIG. 18 shows a diagrammatic illustration of a heat exchanger.

In a further preferred refinement of the invention according to FIG. 18, the heat exchanger 1100 has, for example, a single-row tube/rib system 1101 and two side boxes 1102 and 1103. This heat exchanger is preceded by a further heat exchanger 1199 in the cooling-air stream 1198. The heat exchanger may also be formed from only one tube row or from a plurality of tube rows for which no deflection in depth is provided. In this case, however, deflections in width may be provided, or the part regions of an integrated exchanger lie next to one another.

The configuration principles described above may be applied, in this case too, when the integrated heat exchanger is preceded by at least one further heat exchanger in the cooling-air stream and these are connected, for example, to form a module. This preceding heat exchanger or these preceding heat exchangers are advantageously positioned with respect to the individual regions of the integrated heat exchanger in such a way that the flow routing and temperature level in the preceding heat exchangers corresponds approximately to the situation in the "front half" of an integrated heat exchanger according to the configuration principles of the figures described above.

According to the invention, it may be expedient if, in heat exchangers, the connection pieces for the inlet and/or outlet are not only led out on the cooler rear side or laterally, but, where appropriate, also at the top and bottom or on the cooler front side, as seen in the air flow direction. The connection pieces may in this case be attached or be designed as angle connection pieces or connection pieces led through.

The configuration features of the heat exchangers can not only be applied to the crosscurrent cooler described, but also to downflow or upflow coolers.

The configuration features are also reversible in terms of right/left and top/bottom.

The integration of a plurality of heat exchangers into one structural unit saves, in particular, construction space for the cooling module. Whereas individual heat exchangers would have to be at minimum distances from one another in the cooling module, the heat exchanger regions in a structural unit directly adjoin one another. Specific parts may also assume a double function since, as intermediate elements, they can assume functions for a plurality of heat exchanger regions.

A deflection in depth and/or the arrangement of cooler regions with a low temperature level in the cooling-air stream in front of cooler regions with a high temperature level advantageously improve the effectiveness of the heat exchanger.

The cascading of the coolant stream over a plurality of cooler regions expediently reduces the number of connection pieces required and consequently the number of interfaces. The number of hoses and hose connections required and the coolant content are consequently also reduced.

The stepping of the inlet cross sections of the cooler regions advantageously makes it possible to maintain favorable conditions for heat transmission and pressure drop across all the cooler regions.

Large low-temperature regions which may comprise a plurality of low-temperature coolers are advantageously possible.

The low-temperature regions with a cascaded throughflow may in each case deliver cooling power for the assembly assigned to them and additionally for further assemblies. In this context, "cascaded" means that in each case parts of a fluid stream are branched off in stages or steps and the remainder of the fluid flows further on through the heat exchanger. The fluid quantity flowing further on through the heat exchanger is in this case additionally cooled, so that fluid quantities or mass flows with a different temperature are available at various outlets of the heat exchanger. The respective quantities of the fluid at a given temperature can be controlled accurately by means of the design of the respective regions of the heat exchanger.

Preferably, the regions of the heat exchanger which generate fluid with a lower temperature are preferably arranged in front of or next to other regions with respect to the cooling-air stream or another cooling mass flow.

Figure 19:
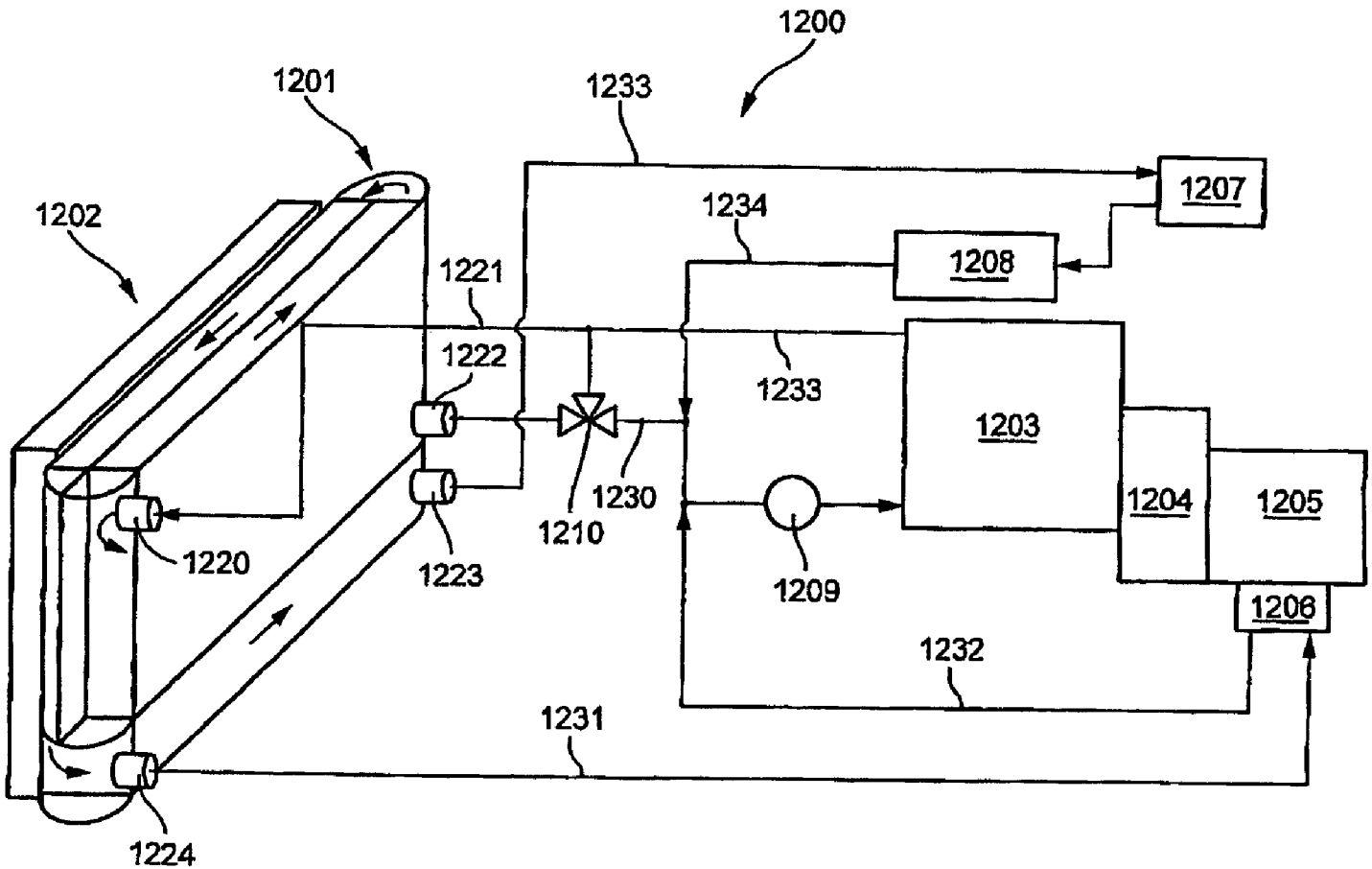
FIG. 19 shows a diagrammatic illustration of a cooling circuit.

FIG. 19 shows the diagrammatic illustration of a cooling circuit with a heat exchanger 1201, a condenser 1202 and assemblies, such as, for example, an engine 1203, a starter generator 1204, a transmission with transmission oil cooler 1206, a cooler for electronics 1207 of the vehicle, a charge air/coolant cooler 1208, a pump 1209, a thermostatic bypass valve 1210 and a multiplicity of lines.

The condenser 1202 may be arranged as an independent component or be designed as a structural unit with the heat exchanger or be integrated with the heat exchanger 1201.

The diagrammatic figure shows by way of example a heat exchanger 1201 according to an illustration of FIG. 17. The heat exchanger 1201 has an inlet 1220, through which a fluid, such as coolant, flows out of the line 1221 into the heat exchanger. The fluid then flows through the fluid connections, for example a tube/rib system, and flows out again partially at the respective outlets 1222, 1223, 1224. The temperatures of the respective coolant stream at the respective outlets are different and, depending on the design, may differ by between approximately 10 degrees Celsius and 40 degrees Celsius or more. In the present example, the temperature at the inlet is approximately 115 degrees Celsius, at the outlet 1222 approximately 110 degrees, at the outlet 1224 approximately 80 degrees and at the outlet 1223 approximately 60 degrees. However, these values depend on the respective configuration of the heat exchanger and of the circuit.

The fluid with the highest temperature flows from the outlet 1222 to the coolant inlet of the engine 1203 via the pump 1209. It is heated there, and the heated fluid flows from the coolant outlet of the engine 1203 through the line 1221 to the heat exchanger inlet 1220. Arranged between the line 1230 and the line 1221 is a thermostatic bypass valve which, according to predetermined characteristic values, at least partially opens or closes the bypass connection, so that the engine can heat up more quickly, for example in a cold start situation, than when the fluid does not run or does not run completely through the cooler.

Connected to the outlet 1224 is a further line 1231 connected to an oil cooler in which heat exchange between the fluid and the transmission oil takes place. The fluid heated in the oil cooler 1206 flows through the line 1232 and enters the line 1230.

Connected to the outlet 1223 is a further line 1233 which is connected to a cooler 1207 for electronics and consequently in series with a charge air/coolant cooler 1208. The fluid heated in this way flows through the line 1234 and enters the line 1230 and, after flowing through the engine, passes into the heat exchanger 1201 again.

It is particularly advantageous that only one pump 1209 is used in this arrangement of a main cooling circuit and of secondary cooling circuits. This is achieved in that the returns of the secondary circuits issue in the main circuit upstream of the pump, that is to say are connected to the suction side of the pump or the low-pressure side of the pump. The secondary cooling circuits are led parallel to the bypass valve 1210.

This pump may be a pump driven by an electric motor or a pump driven by the engine 1203, in which case the pump driven by the electric motor can preferably be operated according to the cooling requirements, that is to say also in the electrically or electronically regulated mode.

The arrangement of a pump for supplying a main cooling circuit and at least one secondary cooling circuit may advantageously be provided, since the at least one secondary circuit is led parallel to the bypass valve 1210.

The invention claimed is:

1. A heat exchanger, comprising:

at least one fluid inlet;

at least two fluid outlets; and an arrangement of fluid connections between inlet, collecting, deflecting and/or outlet chambers, the fluid connections being subdivided into various regions, a first region of fluid connections being arranged between at least one inlet and one first outlet, and a second region of fluid connections being arranged between the first outlet and a second outlet;

wherein individual regions of fluid connections are connected to other regions of fluid connections and/or to an inlet and/or an outlet by inlet, collecting, deflecting and/or outlet chambers arranged in side boxes which are arranged laterally with respect to the fluid connections, and wherein the side boxes are subdivided into various chambers by l-shaped, z-shaped, c-shaped and/or t-shaped walls.

2. The heat exchanger as claimed in claim 1, further comprising a third outlet and a third region of fluid connections provided between the second outlet and the third outlet.

3. The heat exchanger as claimed in claim 1, further comprising a further nth outlet and an nth region of fluid connections provided between the n−1-th outlet and the nth outlet, wherein n is 3, 4, 5, 6, 7, 8, 9, 10 or an integer greater than 10.

4. The heat exchanger as claimed in claim 1, wherein the walls comprise vertical or horizontal walls or walls formed compositely from these.

5. The heat exchanger as claimed in claim 1, further comprising a deflection in depth, in a plane of the fluid connections, between at least one first region of fluid connections and one second region of fluid connections.

6. The heat exchanger as claimed in claim 1, further comprising a deflection in width, in a plane perpendicular to a plane of the fluid connections, between at least one first region of fluid connections and one second region of fluid connections.

7. The heat exchanger as claimed in claim 1, further comprising a deflection in depth and in width, in a plane of the fluid connections and in a plane perpendicular to a plane of the fluid connections, between at least one first region of fluid connections and one second region of fluid connections.

8. The heat exchanger as claimed in claim 1, wherein two regions of fluid connections are routed countercurrently with respect to one another and without an outlet between them.

9. The heat exchanger as claimed in claim 1, further comprising ducts for a further medium or fluid provided between the fluid connections.

10. The heat exchanger as claimed in claim 9, wherein these ducts are formed by ribs between the fluid connections.

11. The heat exchanger as claimed in claim 9, wherein the medium comprises air.

12. The heat exchanger as claimed in claim 9, wherein the medium comprises a fluid or liquid medium.

13. The heat exchanger as claimed in claim 1, wherein the fluid connections are tubes.

14. The heat exchanger as claimed in claim 13, wherein the tubes comprise a plurality of fluid ducts which do not communicate with one another over the length of the tubes.

15. The heat exchanger as claimed in claim 13, wherein the fluid connections or tubes have a plurality of fluid ducts which communicate with one another over the length of the tubes.

16. The heat exchanger as claimed in claim 13, wherein the fluid connections or tubes are arranged in a single row or in a plurality of rows next to one another for each plane of the fluid connections.

17. The heat exchanger according to claim 13, wherein the tubes comprise flat tubes, round tubes, or oval tubes.

18. A motor vehicle comprising a heat exchanger according to claim 1.

19. A fluid circuits, comprising:

at least one heat exchanger according to claim 1 and at least two assemblies which can be supplied by the heat exchanger by fluid lines and which have a fluid inlet and a fluid outlet, wherein a pump with an inlet and outlet is arranged between one outlet of the at least one heat exchanger and one inlet of at least one assembly, and at least one outlet of a further assembly can be connected to the inlet side of the pump.

20. The fluid circuit as claimed in claim 19, wherein the further assembly is connected with its inlet to an outlet of the heat exchanger.

21. The fluid circuit as claimed in claim 19, wherein a plurality of further assemblies are connected in series and have a fluid flowing through them.

22. The fluid circuit as claimed in claim 19, wherein a plurality of further assemblies are connected in parallel and have a fluid flowing through them.

23. The fluid circuit as claimed in claim 19, wherein the inlet of a further assembly is connected to an outlet of the heat exchanger.

24. A motor vehicle comprising a fluid circuit according to claim 19.

* * * * *